US006731891B1

(12) United States Patent
Calamita et al.

(10) Patent No.: US 6,731,891 B1
(45) Date of Patent: May 4, 2004

(54) TRANSFER ROLL ENGAGEMENT METHOD FOR MINIMIZING MOTION QUALITY DISTURBANCES

(75) Inventors: James P. Calamita, Rochester, NY (US); Vincent M. Williams, Palmyra, NY (US)

(73) Assignee: Xerox Corproation, Stamford, CT (US)

( * ) Notice: Subject to any disclaimer, the term of this patent is extended or adjusted under 35 U.S.C. 154(b) by 0 days.

(21) Appl. No.: 10/462,340

(22) Filed: Jun. 13, 2003

(51) Int. Cl.[7] ..... G03G 15/16
(52) U.S. Cl. ..... 399/66; 399/167
(58) Field of Search ..... 399/66, 36, 121, 399/167, 297, 301, 313

(56) References Cited

U.S. PATENT DOCUMENTS 5,729,788 A * 3/1998 Hirohashi et al. ..... 399/66
5,946,525 A * 8/1999 Okamura et al. ..... 399/66
6,400,913 B1 6/2002 de Jong et al. ..... 399/66

* cited by examiner

*Primary Examiner*—Hoang Ngo
(74) *Attorney, Agent, or Firm*—Perman & Green, LLP

(57) ABSTRACT

A method of maintaining a rotational velocity of an imaging drum in an image producing device includes constructing a table of a drive current for a transfer roll for a plurality of first distances between the imaging drum with the transfer roll, and utilizing the table to control the transfer roll drive to maintain a substantially constant imaging drum rotational velocity at each of the plurality of distances.

20 Claims, 3 Drawing Sheets

TRANSFER ROLL ENGAGEMENT METHOD FOR MINIMIZING MOTION QUALITY DISTURBANCES

BACKGROUND

1. Field

The disclosed embodiments relate to image producing devices and, more particularly, to a system and method for reducing motion quality defects while printing or copying an image.

2. Brief Description of Related Developments

Electrophotographic marking is typically performed by exposing a light image of an original document or image onto a uniformly charged photoreceptor. In response to the light image, the photoreceptor discharges so as to create an electrostatic pattern of the original document. Toner is attracted to the electrostatic pattern to form an image on the photoreceptor. A number of photoreceptors may be mounted on an imaging drum and the images may be transferred from the imaging drum, either directly, or after an intermediate transfer step, and fused onto a marking substrate or media, such as a sheet of paper.

The transfer and fusing may be accomplished by pinching the media between the imaging drum and a transfer roll. The point where the imaging drum and transfer roll are in contact with the media may be referred to as a nip. The media is pinched between the imaging drum and the transfer roll such that a fusing pressure is created in the nip, which may be accompanied by the generation or application of heat, to fuse the image to the media.

Other techniques may also be used for applying an image to an imaging drum or portion of an imaging drum for subsequent transfer to the media. For example, a direct marking technique may be used where a charged, colorless toner layer may be applied to the imaging drum. A non-contacting ink jet marking technology may be used to apply an ink jet image to the imaging drum, for example, thermal ink jet, acoustic ink jet, piezo ink jet, or any other type of suitable direct marking technique.

Regardless of the technique used to produce an image on the imaging drum, the image is generally transferred to the media by pinching the media between the imaging drum and the transfer roll, fusing or fixing the image to the media as mentioned above.

When the transfer roller is fully engaged with the imaging drum, it may apply a load in the range of approximately 500–700 lbs. in a relatively short period of time. The addition and removal of such a load in such a period of time may cause the velocity of the imaging drum to deviate, resulting in a transient rotational disturbance of the drum. Additionally, there may be a steady state velocity change due to the load. The inertia of the imaging drum and its control system may be large enough so that the control system's closed loop bandwidth cannot accommodate these velocity deviations, resulting in image mis-registration, or other undesirable effects, referred to as motion quality problems.

Currently, when performing marking operations that require multiple passes, the processes of forming the image on the imaging drum and transferring the image to the media are performed sequentially. The imaging must be completed before beginning the transfer process because of the motion quality problems associated with engaging the transfer roller with the imaging drum after the image has been formed on the imaging drum. As a result, productivity is limited by performing the imaging and transferring operations in series. When using an imaging drum with more than imaging surface, also referred to as a pitch, the image formed on one pitch must be transferred before an image may be formed on another pitch.

SUMMARY

The disclosed embodiments are directed to a method of maintaining a rotational velocity of an imaging drum in an image producing device. In one embodiment, a table is constructed of a drive current for a transfer roll for a plurality of first distances between the imaging drum with the transfer roll, and utilizing the table to control the transfer roll drive to maintain a substantially constant imaging drum rotational velocity at each of the plurality of distances.

Another embodiment is directed to constructing a table of a drive current for a transfer roll for a plurality of engagement and disengagement positions of the imaging drum with the transfer roll, and utilizing the table to control the transfer roll drive to maintain a substantially constant imaging drum rotational velocity during engagement and disengagement with the transfer roll.

A further embodiment includes measuring a drive current of the imaging drum, incrementally moving the transfer roll to engage and disengage the imaging drum, and adjusting a current set point of a transfer roll drive to maintain the measured imaging drum drive current at each incremental movement. This embodiment also includes recording the adjusted current set point for each incremental movement in a table, and utilizing the table to control the transfer roll drive current to maintain a substantially constant imaging drum rotational velocity during subsequent engagement and disengagement with the transfer roll.

BRIEF DESCRIPTION OF THE DRAWINGS

The foregoing aspects and other features of the disclosed embodiments are explained in the following description, taken in connection with the accompanying drawings, wherein.

DETAILED DESCRIPTION OF THE PREFERRED EMBODIMENT(s)

Figure 1:
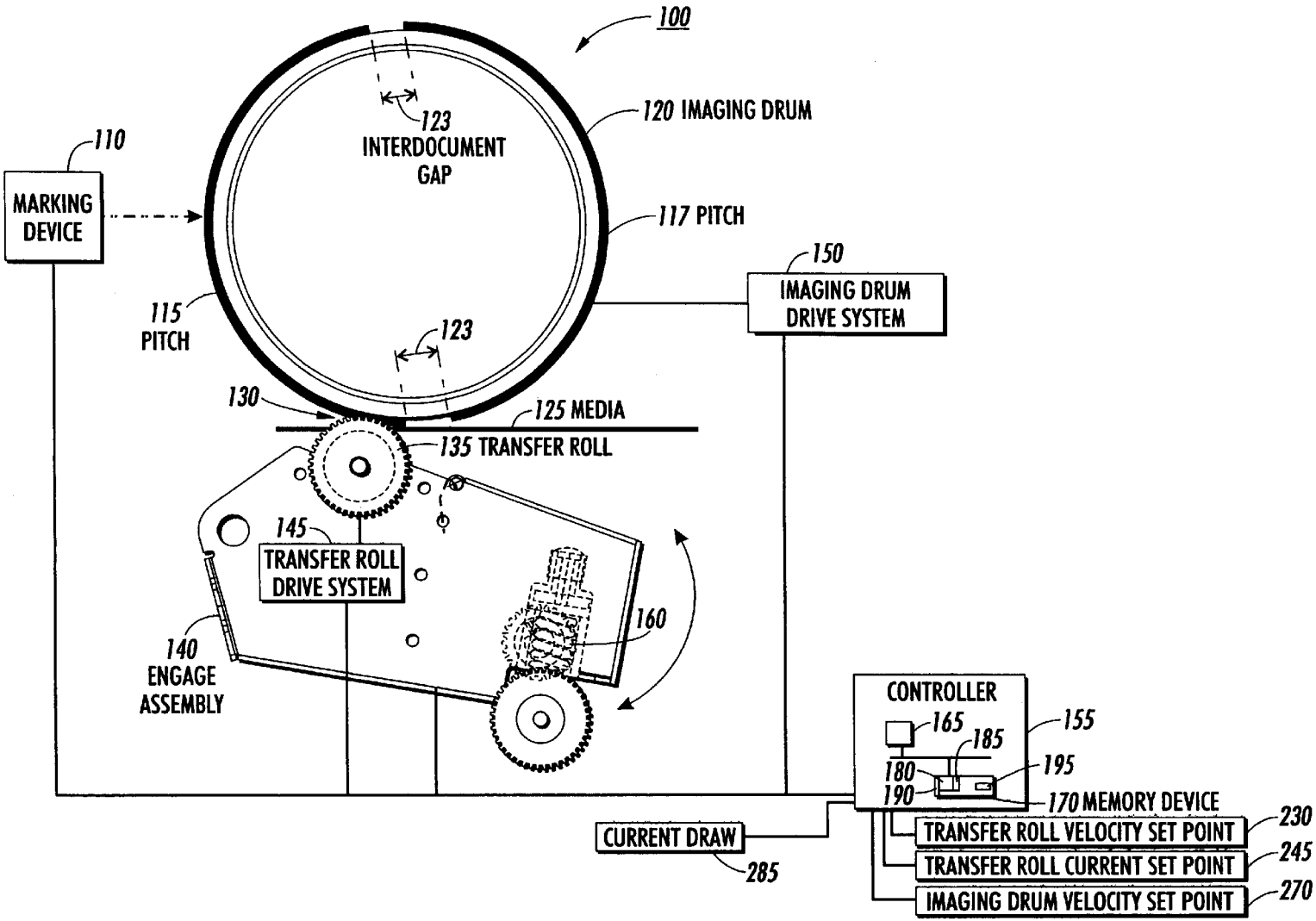
FIG. 1 is diagram of a portion of a system incorporating features of the disclosed embodiments.

Referring to FIG. 1, one embodiment of a system 100 incorporating features of the disclosed embodiments is illustrated. Although the embodiments disclosed will be described with reference to the embodiments shown in the drawings, it should be understood that the embodiments disclosed can be embodied in many alternate forms of embodiments. In addition, any suitable size, shape or type of elements or materials could be used.

As shown in FIG. 1, system 100 generally comprises an image marking/transfer portion of a printing/copying device, such as that shown in U.S. Pat. No. 4,032,225, issued Jun. 28, 1977, the disclosure of which is incorporated herein by reference. In one embodiment, the printing/copying device comprises a xerographic printing/copying system, however, other printing and copying systems may also incorporate the features of the disclosed embodiments. For purposes of the description herein, only the image marking/transfer portion, with reference to FIG. 1, of a printing/copying device will described herein.

Referring to FIG. 1, the marking/image transfer system 100 generally comprises an imaging drum system and a transfer roll system. The imaging drum system generally provides for applying images on an imaging drum and the transfer of the image to a suitable media. The transfer roll system is generally adapted to cause the engagement and disengagement of a transfer roll with the imaging drum 120 during the image transfer process. In one embodiment, the imaging drum system comprises a solid ink drum system, although any suitable imaging system that applies images on a drum for transfer to a media can be used. The transfer roll system is generally adapted to cause the transfer roll to engage and disengage the imaging drum while maintaining a rotational velocity of the imaging drum at a nominal speed. It is a feature of the disclosed embodiments to provide a motor torque assist for the imaging drum to enable parallel imaging/transferring and reduce motion quality impacts of engagement and disengagement of the transfer roll.

As shown in FIG. 1, one embodiment of the imaging drum system includes an imaging drum 120, an imaging drum drive system 150 and a marking device 110. Imaging drum 120 is adapted to include at least one pitch 115. In FIG. 1, imaging drum 120 includes a first pitch 115 and a second pitch 117. The boundaries between first and second pitches 115, 117 may be defined by one or more inter-document gaps 123. Imaging drum drive system 150 operates to maintain imaging drum 120 at a substantially constant rotational velocity. Marking device 110 generally operates to apply an image on at least one pitch 115 of imaging drum 120. In FIG. 1, marking device 110 is capable of applying an image to both pitches, 115, 117.

One embodiment of the transfer roll system includes a transfer roll 135, a transfer roll drive system 145, and an engagement assembly 140. Engagement assembly 140 is adapted to move transfer roll 135 into engagement with imaging drum 120 in the area of a nip 130 to transfer one or more images thereon to media 125. Media 125 may include any substrate suitable for applying images thereon and may comprise individual sheets or a continuous roll.

In the presently disclosed embodiments, one example of the motor torque assist includes measuring a drive current of imaging drum drive system 150, recording the drive current of transfer roll drive system 145 during transfer roll 135 and imaging drum 120 engagement and disengagement required to maintain the measured imaging drum drive current, and using the recorded drive current to operate transfer roll drive system 145 to minimize imaging drum velocity variations during subsequent engagement and disengagement.

Marking device 110, engagement assembly 140, transfer roll drive system 145, and imaging drum drive system 150 may be operated by a controller 155. Controller 155 may include logic circuitry for generally controlling the operation of system 100, and include a processor 165 that operates programs in a memory device 170. Memory device 170 may also be capable of storing data.

In one embodiment, engagement assembly 140 may include an engagement motor 160 which operates to move transfer roll 135 toward or away from imaging drum 120. Other engagement mechanisms and techniques may also be used so long as imaging drum 120 and transfer roll 135 are capable of being brought together and moved apart as described herein.

System 100 may also include a media transport mechanism (not shown) for transporting media 125 through nip 130.

Transfer roll drive system 145 is adapted to operate at least in a constant velocity mode and a current drive mode. In the constant velocity drive mode, transfer roll drive system 145 operates to maintain transfer roll 130 substantially at a particular rotational velocity. In the current drive mode, transfer roll drive system 145 operates to drive transfer roll 130 according to a current set point.

Imaging drum drive system 150 is adapted to operate at least in a constant velocity mode, where imaging drum drive system 150 operates to maintain imaging drum 120 substantially at a particular rotational velocity.

Figure 2:
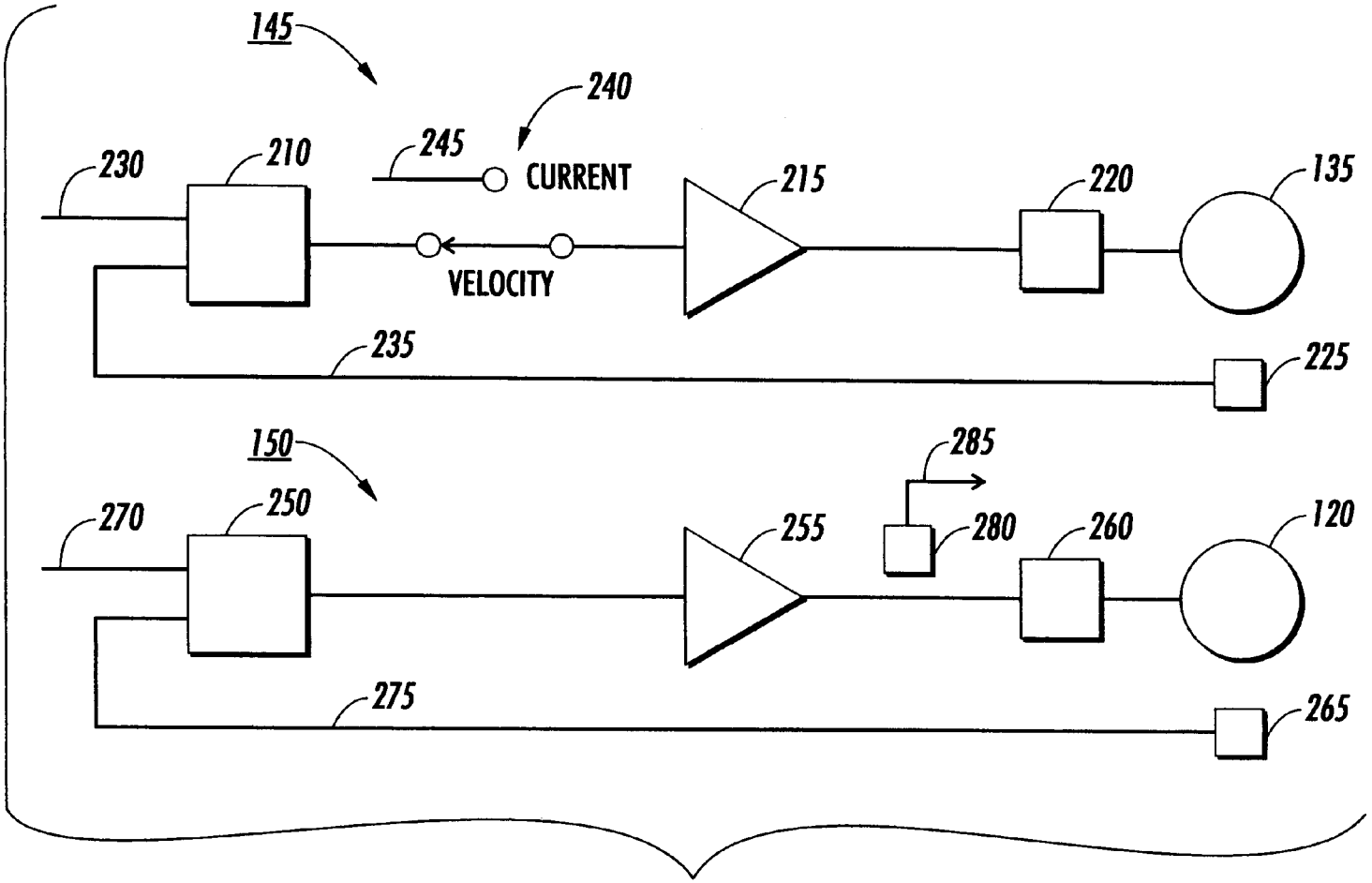
FIG. 2 is a schematic diagram of one embodiment of a transfer roll drive system and an imaging drum drive system in accordance with the disclosed embodiments.

FIG. 2 shows schematic diagrams of exemplary embodiments of transfer roll drive system 145 and imaging drum drive system 150.

Transfer roll drive system 145 is adapted to operate at least in a constant velocity mode and a current drive mode. In the constant velocity drive mode, transfer roll drive system 145 operates to maintain transfer roll 130 substantially at a particular rotational velocity. In the current drive mode, transfer roll drive system 145 operates to drive transfer roll 130 according to a current set point.

Transfer roll drive system 145 may include a transfer roll velocity servo controller 210, a transfer roll amplifier 215, a transfer roll motor 220, and a transfer roll velocity sensor 225. Controller 155 (FIG. 1) may apply a transfer roll velocity set point on signal line 230, and transfer roll velocity sensor 225 may apply a feedback signal on line 235. Transfer roll velocity servo controller 210 may then apply a signal to transfer roll amplifier 215 which in turn applies power to transfer roll motor 220.

When switch 240 is in the velocity position, transfer roll velocity servo controller 210 operates to maintain the velocity of transfer roll 135 substantially at the transfer roll velocity set point. When switch 240 is in the current position, transfer roll amplifier 215 operates as a current source, responsive to a current set point applied to signal line 245 by controller 155 (FIG. 1).

Imaging drum drive system 150 is adapted to generally operate at least in a constant velocity mode. In the constant velocity drive mode, imaging drum drive system 150 operates to maintain imaging drum 120 substantially at a particular rotational velocity. Imaging drum drive system 150 may include an imaging drum velocity servo controller 250, an imaging drum amplifier 255, an imaging drum motor 260, and an imaging drum velocity sensor 265. Controller 155 (FIG. 1) may apply an imaging drum velocity set point on signal line 270, and imaging drum velocity sensor 265 may apply a feedback signal on line 275. Imaging drum velocity servo controller 250 may then apply a signal to imaging drum amplifier 255 which in turn applies power to imaging drum motor 260. Imaging drum drive system 150 may also include a current sensor 280 for sensing the current draw of imaging drum motor 260.

During copying or printing, marking device 110 applies a first image to pitch 115. When the first image is complete, engagement assembly 140 causes transfer roll 135 to move toward and engage imaging drum 120, forming nip 130. Media 125 is passed through nip 130 and the first image is transferred from imaging drum 120 to media 125 by rotating imaging drum 120 with respect to the surface of media 125. While the first image is being transferred to media 125, marking device 110 may be applying a second image to pitch 117. After the first image is transferred to media 125, if the second image is complete, it may also be transferred to media 125 at nip 130. Otherwise, transfer roll 135 may be disengaged from imaging drum 120 when inter-document gap 123 reaches nip 130. When marking device 110 completes the second image application, transfer roll 135 and imaging drum 120 may then be re-engaged to transfer the second image to media 125.

Engagement and disengagement of transfer roll 135 and imaging drum 120 is generally performed when inter-document gap is at or near nip 130. As mentioned above, when transfer roll 135 is fully engaged with imaging drum 120, a load in the range of approximately 500–700 lbs. may be applied to imaging drum 120. Full engagement, and thus full loading, generally occurs as inter-document gap 123 traverses nip 130, which typically takes place in approximately 50 ms. Without compensating for this load change, the velocity of imaging drum 120 will fluctuate, causing motion quality problems.

Motion quality requirements may dictate that imaging drum 120 remain within at least +/−2% of its nominal velocity. Certain techniques used to apply images to imaging drum 120 may allow for some variation in imaging drum velocity, but generally may not be able to compensate for variations significantly larger than this range.

The disclosed embodiments include driving transfer roll 135 in a manner that compensates for imaging drum velocity disturbances due to engagement and disengagement. The disclosed embodiments include a learning, or set-up procedure to record an amount of current applied to transfer roll drive system 145 to maintain a particular current draw of imaging drum drive system 150 during engagement and disengagement as shown in FIG. 3.

Figure 3:
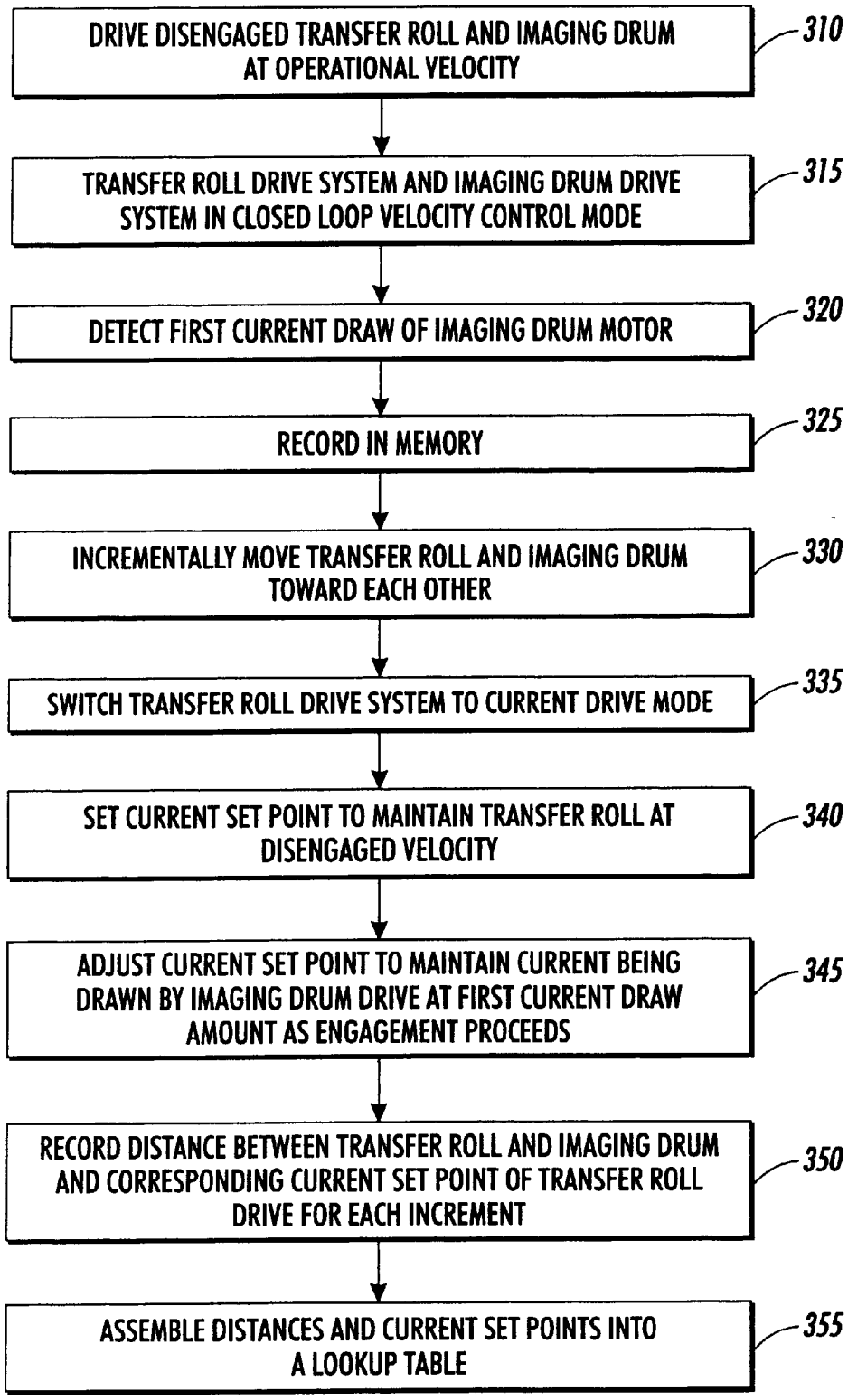
FIG. 3 is a flow chart of a learning, or set-up procedure for assembling a table for use by the transfer roll drive system during engagement and disengagement of the imaging drum and the transfer roll.

Referring to step 310 of FIG. 3, the learning procedure may begin by driving disengaged transfer roll 135 and imaging drum 120 at their respective operational velocities with transfer roll drive system 145 and imaging drum drive system 150 both in a closed loop velocity control mode (step 315). A first current draw of imaging drum motor 260 as detected by current sensor 280 (step 320) is recorded by controller 155 in memory 170 (step 325). Transfer roll 135 and imaging drum 120 are incrementally moved toward each other, for example, by operating engagement motor 160 (step 330). As transfer roll 135 and imaging drum 120 begin to engage, transfer roll drive system 145 is switched to a current drive mode (step 335) where the current set point is initially set such that transfer roll 135 maintains its disengaged velocity (step 340). The current set point of transfer roll drive system 145 is adjusted during the engagement process so that the amount of current being drawn by imaging drum drive system 150 is maintained at the first current draw amount (step 345).

As engagement motor 160 is incremented, the distance between transfer roll 135 and imaging drum 120, for example, as represented by a position of engagement motor 160, along with the corresponding current set point of transfer roll drive system 145 is recorded in memory 170 for each increment until transfer roll 135 and imaging drum 120 are completely engaged (step 350).

The distances or positions and current set points may be assembled into a first lookup table 180 that correlates an amount of load compensating drive current with a distance between transfer roll 135 and imaging drum 120 (step 355). A similar learning procedure may be implemented for the disengagement of transfer roll 135 and imaging drum 120, that is, the distance between transfer roll 135 and imaging drum 120, along with the corresponding current set point of transfer roll drive system 145 is recorded in memory 170 for each incremental movement until transfer roll 135 and imaging drum 120 are completely disengaged, and the recordations may be assembled into a second lookup table 185. Second table 185 should be similar to first table 180 generated for the engagement operation. First and second lookup tables 180, 185 may be combined to form a single lookup table 190 that may be used for both engagement and disengagement of transfer roll 135 and imaging drum 120.

Lookup table 180 may be utilized during later engagement and disengagement operations to minimize disturbances of the imaging drum velocity. For example, a subsequent marking operation may begin with transfer roll 135 and imaging drum 120 disengaged. Controller 155 may cause transfer roll drive system 145 to switch to a closed loop velocity control mode, and may cause disengaged transfer roll 135 and imaging drum 120 to operate at their respective operational velocities. Engagement motor 160 may then be successively incremented, moving transfer roll 135 toward imaging drum 120. As transfer roll 135 and imaging drum 120 begin to engage, transfer roll drive system 145 may be switched to a current drive mode. For each incremental movement, or distance between transfer roll 135 and imaging drum 120, for example, as represented by a position of engagement motor 160, the current set point for transfer roll drive system 145 is set according to look up table 180. Similarly, after image transfer is complete, during disengagement, as transfer roll 135 and imaging drum 120 are moving away from each other, the current set point for transfer roll drive system 145 for each distance between transfer roll 135 and imaging drum 120 may also be obtained from lookup table 180.

In another embodiment, lookup table 180 may be used for each engagement position and lookup table 185 may be used for each disengagement position. In still another embodiment, lookup table 190 may be used for each engagement position and disengagement position.

Returning to FIG. 1, memory device 170 may also include program storage devices 195 for storing software and computer programs incorporating the learning or setup procedure described above to executed by processor 165. The software and computer programs may be in the form of machine readable program source code. Controller 155 may be generally adapted to utilize program storage devices 195 embodying the machine readable program source code to perform the steps of the disclosed embodiments. Program storage devices 195 may include magnetic, optical, semiconductor, or any other type of suitable media.

Thus, as subsequent engagement and disengagement proceed, transfer roll 135 is driven to compensate for the load on imaging drum 120 to minimize any velocity variations that may occur as a result of the changes in load. As a result, the system 100 compensates for both transient rotational disturbances and steady state velocity changes due to the load changes associated with engagement and disengagement. Image mis-registration and other related motion quality problems are minimized. In addition, images may be formed on one or more pitches of imaging drum 120 while other images are being transferred from other pitches to media 125. Thus, image forming and image transferring operations may be performed in parallel, increasing system productivity.

While particular embodiments have been described, various alternatives, modifications, variations, improvements,.

and substantial equivalents that are or may be presently unforeseen may arise to Applicant's or others skilled in the in the art. Accordingly, the appended claims as filed and as they may be amended are intended to embrace all such alternatives, modifications, variations, improvements and substantial equivalents.

What is claimed is:

1. A method of maintaining a rotational velocity of an imaging drum in an image producing device comprising:

constructing a table of a drive current for a transfer roll for a plurality of first distances between the imaging drum with the transfer roll; and utilizing the table to control the transfer roll drive to maintain a substantially constant imaging drum rotational velocity at each of the plurality of distances.

2. The method of claim 1, wherein constructing a table comprises:

measuring an imaging drum drive current while the imaging drum and the transfer roll are disengaged at a second distance apart from each other;

moving the imaging drum and the transfer roll through the plurality of first distances;

adjusting a current set point of the transfer roll drive to maintain the measured imaging drum drive current at each of the plurality of first distances; and recording the adjusted current set point for each of the plurality of first distances.

3. The method of claim 2, wherein utilizing the table comprises:

moving the imaging drum and the transfer roll through the plurality of first distances; and setting the current set point of the transfer roll drive to the recorded adjusted current set point for each of the plurality of first positions.

4. A method of maintaining a rotational velocity of an imaging drum in an image producing device comprising:

constructing a table of a drive current for a transfer roll for a plurality of engagement and disengagement positions of the imaging drum with the transfer roll; and utilizing the table to control the transfer roll drive to maintain a substantially constant imaging drum rotational velocity during engagement and disengagement with the transfer roll.

5. The method of claim 4, wherein constructing a table comprises:

measuring an imaging drum drive current while the imaging drum and the transfer roll are disengaged;

incrementally positioning the transfer roll to engage the imaging drum;

adjusting a current set point of the transfer roll drive to maintain the measured imaging drum drive current at each position; and recording the adjusted current set point for each position.

6. The method of claim 5, wherein utilizing the table comprises:

incrementally positioning the transfer roll to engage and disengage the imaging drum; and setting the current set point of the transfer roll drive to the recorded adjusted current set point for each incremental position.

7. The method of claim 4, wherein constructing a table comprises:

setting the transfer roll drive and imaging drum drive to a closed loop velocity control mode;

driving the transfer roll and the imaging drum at respective operational velocities while the imaging drum and the transfer roll are disengaged;

measuring an imaging drum drive current;

incrementally moving the transfer roll to engage the imaging drum;

switching the transfer roll drive to current drive mode;

adjusting a current set point of the transfer roll drive to maintain the measured imaging drum drive current at each incremental movement of engagement; and recording the adjusted current set point for each incremental movement of engagement.

8. The method of claim 7, wherein constructing a table further comprises:

incrementally moving the transfer roll to disengage the imaging drum;

adjusting a current set point of the transfer roll drive to maintain the measured imaging drum drive current at each incremental movement of disengagement;

recording the adjusted current set point for each incremental movement of disengagement.

9. A method of maintaining a rotational velocity of an imaging drum during engagement with a transfer roll in an image producing device comprising:

measuring a drive current of the imaging drum;

incrementally moving the transfer roll to engage and disengage the imaging drum;

adjusting a current set point of a transfer roll drive to maintain the measured imaging drum drive current at each incremental movement;

recording the adjusted current set point for each incremental movement in a table; and utilizing the table to control the transfer roll drive current to maintain a substantially constant imaging drum rotational velocity during subsequent engagement and disengagement with the transfer roll.

10. The method of claim 9, wherein measuring a drive current of the imaging drum comprises:

setting the transfer roll drive and imaging drum drive to a closed loop velocity control mode;

driving the transfer roll and the imaging drum at respective operational velocities while the imaging drum and the transfer roll are disengaged; and measuring the imaging drum drive current.

11. The method of claim 9, wherein utilizing the table comprises:

switching the transfer roll drive to current drive mode;

incrementally moving the transfer roll to engage and disengage the imaging drum; and setting the current set point of the transfer roll drive to the recorded adjusted current set point for each incremental movement.

12. A computer program product comprising:

a computer useable medium having computer readable code means embodied therein for causing a computer to maintain a rotational velocity of an imaging drum in an image producing device, the computer readable code means in the computer program product comprising:

computer readable program code means for causing a computer to construct a table of a drive current for a transfer roll for a plurality of first distances between the imaging drum with the transfer roll; and computer readable program code means for causing a computer to utilize the table to control the transfer roll drive to maintain a substantially constant imaging drum rotational velocity at each of the plurality of distances.

13. The computer program product of claim 12, wherein the computer readable program code means for causing a computer to construct a table further comprises:

computer readable program code means for causing a computer to measure an imaging drum drive current while the imaging drum and the transfer roll are disengaged at a second distance apart from each other;

computer readable program code means for causing a computer to move the imaging drum and the transfer roll through the plurality of first distances;

computer readable program code means for causing a computer to adjust a current set point of the transfer roll drive to maintain the measured imaging drum drive current at each of the plurality of first distances; and computer readable program code means for causing a computer to record the adjusted current set point for each of the plurality of first distances.

14. The computer program product of claim 13, wherein the computer readable program code means for causing a computer to utilize the table further comprises:

computer readable program code means for causing a computer to move the imaging drum and the transfer roll through the plurality of first distances; and computer readable program code means for causing a computer to set the current set point of the transfer roll drive to the recorded adjusted current set point for each of the plurality of first positions.

15. A computer program product comprising:

a computer useable medium having computer readable code means embodied therein for causing a computer to maintain a rotational velocity of an imaging drum during engagement with a transfer roll in an image producing device, the computer readable code means in the computer program product comprising:

computer readable program code means for causing a computer to measure a drive current of the imaging drum;

computer readable program code means for causing a computer to incrementally move the transfer roll to engage and disengage the imaging drum;

computer readable program code means for causing a computer to adjust a current set point of a transfer roll drive to maintain the measured imaging drum drive current at each incremental movement;

computer readable program code means for causing a computer to record the adjusted current set point for each incremental movement in a table; and computer readable program code means for causing a computer to utilize the table to control the transfer roll drive current to maintain a substantially constant imaging drum rotational velocity during subsequent engagement and disengagement with the transfer roll.

16. The computer program product of claim 15, wherein the computer readable program code means for causing a computer to measure a drive current of the imaging drum comprises:

computer readable program code means for causing a computer to set the transfer roll drive and imaging drum drive to a closed loop velocity control mode;

computer readable program code means for causing a computer to drive the transfer roll and the imaging drum at respective operational velocities while the imaging drum and the transfer roll are disengaged; and computer readable program code means for causing a computer to measure the imaging drum drive current.

17. The computer program product of claim 15, wherein the computer readable program code means for causing a computer to utilize the table comprises:

computer readable program code means for causing a computer to switch the transfer roll drive to current drive mode;

computer readable program code means for causing a computer to incrementally move the transfer roll to engage and disengage the imaging drum; and computer readable program code means for causing a computer to set the current set point of the transfer roll drive to the recorded adjusted current set point for each incremental movement.

18. An article of manufacture comprising:

a computer useable medium having computer readable code means embodied therein for causing a computer to maintain a rotational velocity of an imaging drum in an image producing device, the computer readable code means in the computer program product comprising:

computer readable program code means for causing a computer to construct a table of a drive current for a transfer roll for a plurality of first distances between the imaging drum with the transfer roll; and computer readable program code means for causing a computer to utilize the table to control the transfer roll drive to maintain a substantially constant imaging drum rotational velocity at each of the plurality of distances.

19. The article of manufacture of claim 18, wherein the computer readable program code means for causing a computer to construct a table further comprises:

computer readable program code means for causing a computer to measure an imaging drum drive current while the imaging drum and the transfer roll are disengaged at a second distance apart from each other;

computer readable program code means for causing a computer to move the imaging drum and the transfer roll through the plurality of first distances;

computer readable program code means for causing a computer to adjust a current set point of the transfer roll drive to maintain the measured imaging drum drive current at each of the plurality of first distances; and computer readable program code means for causing a computer to record the adjusted current set point for each of the plurality of first distances.

20. The article of manufacture of claim 19, wherein the computer readable program code means for causing a computer to utilize the table further comprises:

computer readable program code means for causing a computer to move the imaging drum and the transfer roll through the plurality of first distances; and computer readable program code means for causing a computer to set the current set point of the transfer roll drive to the recorded adjusted current set point for each of the plurality of first positions.

* * * * *